US010889992B2

(12) United States Patent
Folkersen et al.

(10) Patent No.: US 10,889,992 B2
(45) Date of Patent: Jan. 12, 2021

(54) ROOF HEADWALL AND SLOPED WALL FLASHING WITH LEDGE

(71) Applicant: Roofers' Advantage Products LLC, E. Wakefield, NH (US)

(72) Inventors: Jonny E. Folkersen, East Wakefield, NH (US); Benjamin J. Folkersen, East Wakefield, NH (US)

(73) Assignee: Roofers Advantage Products, LLC, E. Wakefield, NH (US)

( * ) Notice: Subject to any disclaimer, the term of this patent is extended or adjusted under 35 U.S.C. 154(b) by 0 days.

(21) Appl. No.: 16/355,358

(22) Filed: Mar. 15, 2019

(65) Prior Publication Data

US 2019/0284813 A1 Sep. 19, 2019

Related U.S. Application Data

(60) Provisional application No. 62/662,365, filed on Apr. 25, 2018, provisional application No. 62/643,335, filed on Mar. 15, 2018.

(51) Int. Cl.

| | |
|---|---|
| ***E04D 13/14*** | (2006.01) |
| ***E04D 13/147*** | (2006.01) |
| ***E04D 1/30*** | (2006.01) |
| ***E04B 7/18*** | (2006.01) |

(52) U.S. Cl.

CPC ..... *E04D 13/1475* (2013.01); *E04B 7/18* (2013.01); *E04D 1/30* (2013.01); *E04D 2001/301* (2013.01); *E04D 2013/1422* (2013.01)

(58) Field of Classification Search

CPC ..... E04D 13/15; E04D 13/1478; E04D 13/04; E04D 13/1475

See application file for complete search history.

(56) References Cited

U.S. PATENT DOCUMENTS

| | | | | | |
|---|---|---|---|---|---|
| 1,685,525 | A | * | 9/1928 | Dow | E04D 13/1415 52/58 |
| 1,860,240 | A | * | 5/1932 | Friedrich | E04D 13/1415 52/60 |
| 3,243,926 | A | * | 4/1966 | Keyt | E04D 13/15 52/94 |
| 3,415,020 | A | * | 12/1968 | Windle | E04D 13/15 52/96 |
| 3,436,877 | A | | 6/1969 | Gunning | |
| 4,254,594 | A | | 3/1981 | Hammond | |
| 4,332,117 | A | * | 6/1982 | Quinnell | E04D 13/1585 52/94 |
| 4,594,820 | A | | 6/1986 | Render | |
| 4,665,667 | A | * | 5/1987 | Taylor | E04D 13/155 52/96 |

(Continued)

*Primary Examiner* — Gisele D Ford
(74) *Attorney, Agent, or Firm* — Maine Cernota & Rardin

(57) ABSTRACT

Headwall flashing and sloped wall flashing, each having a ledge, where the ledges are designed to meet at an outside corner of a roof protrusion comprising a headwall and a cheek wall, the headwall flashing being configured to abut a face of the roof protrusion and having a downwardly-angled ledge that ties into the ledge of the sloped roof flashing, which is angled such that it forms a consistent ledge for installation of siding up a cheek wall, despite the siding creating a shimming effect that would typically result in a stepped appearance and misalignment thereof.

22 Claims, 5 Drawing Sheets

(56) References Cited

U.S. PATENT DOCUMENTS 4,780,997 A * 11/1988 Taylor ..... E04D 13/15 52/96
4,780,999 A 11/1988 Webb
5,065,553 A 11/1991 Magid
5,109,641 A * 5/1992 Halan ..... E04D 13/1478 52/276
D342,326 S * 12/1993 Hansson ..... D25/119
5,328,406 A 7/1994 Morris, Jr.
5,337,526 A * 8/1994 Hartman ..... E04D 13/1475 52/518
D354,733 S * 1/1995 Ingraham ..... D13/155
5,522,189 A 6/1996 Mortensen
5,586,414 A 12/1996 Tawzer
D422,095 S 3/2000 Thagard, III
6,035,587 A 3/2000 Dressler
6,186,605 B1 * 2/2001 Nelson ..... A47B 77/022 312/140.4
D438,650 S * 3/2001 Neuhofer, Jr. ..... D25/199
D452,918 S 1/2002 Ohanesian
6,715,237 B2 * 4/2004 Batt, Sr. ..... E04D 13/1475 52/11
6,780,099 B1 8/2004 Harper
6,848,220 B2 * 2/2005 Faurholdt ..... E04D 13/1475 52/58
6,880,302 B1 * 4/2005 Fontaine ..... B44C 7/022 160/371
7,451,572 B1 * 11/2008 Inzeo ..... E04D 3/405 52/300
7,546,719 B1 * 6/2009 Guevara ..... E04F 13/06 52/302.6
7,941,989 B2 5/2011 Morsching
8,281,521 B1 10/2012 Rasmussen
8,316,587 B2 11/2012 Shugart
8,739,470 B1 6/2014 Wayne
8,869,466 B2 10/2014 Garcia
9,200,450 B2 12/2015 Thagard, III
9,394,693 B2 7/2016 Daniels
9,650,787 B2 5/2017 Montojo
10,000,930 B2 6/2018 Lowe
10,036,166 B1 7/2018 Heo
10,125,497 B2 * 11/2018 Givens ..... E04D 13/1478
D844,182 S * 3/2019 Folkersen ..... D25/199
2002/0178671 A1 12/2002 Gembala
2004/0016201 A1 1/2004 Folkersen
2004/0103592 A1 6/2004 Edvardsen
2005/0005551 A1 1/2005 Graham
2005/0086873 A1 4/2005 Mares
2006/0016130 A1 1/2006 Lin
2006/0254169 A1 * 11/2006 McFadden ..... E04F 13/06 52/344
2007/0074466 A1 4/2007 Rasmussen
2007/0266657 A1 11/2007 Gembala
2008/0005975 A1 1/2008 Thompson
2010/0300011 A1 12/2010 Crego
2011/0049118 A1 3/2011 Nark
2012/0102849 A1 5/2012 Shugart
2017/0266741 A1 9/2017 Chuang
2018/0066436 A1 3/2018 Stiglmayr
2018/0223537 A1 8/2018 Bredeweg
2018/0347197 A1 12/2018 Folkersen
2019/0284810 A1 * 9/2019 Folkersen ..... E04D 13/155
2019/0284814 A1 * 9/2019 Folkersen ..... E04D 13/1478

* cited by examiner

ROOF HEADWALL AND SLOPED WALL FLASHING WITH LEDGE

RELATED APPLICATIONS

This application claims the benefit of U.S. Provisional Application Nos. 65/662,365, filed Apr. 25, 2018, and No. 60/643,335, filed Mar. 15, 2018. Each of these applications is herein incorporated by reference in their entirety for all purposes.

FIELD OF THE INVENTION

The invention relates to roofing, and, more particularly, to flashing used in roof applications.

BACKGROUND OF THE INVENTION

A headwall is defined by the junction between a sloped roof and the face of a wall. It is typical to use metal flashing at this juncture to ensure that the building envelope is sealed against water intrusion. Such flashing is referred to as headwall flashing.

Headwall flashing extends up the wall and is covered with exterior siding, stucco, or other finishes. A base of the headwall flashing typically extends over and onto the completed roofing system along the headwall, which may be contrasted with cheek walls, where each course of shingles is stepped out using flashing between each individual course of shingles. The use of flat stock materials has not necessitated concerns relating to angles and the joining of metals at corners.

Where siding or stucco is used on the wall, consistent placement of the siding or stucco is difficult. Said another way, the siding applicator has no defined termination point along the roof edge on which to base their mounting of the siding. This results in variability of siding reveals and also direct exposure of siding to weather events, which may be deflected by the roof and thereby drive rain underneath the siding and/or result in wind pulling the siding away from the wall.

What is needed, therefore, is a flashing system suitable for use on roof protrusions comprising both head and cheek walls that effectively protects the building envelope from weather-related events while ensuring consistent application of siding.

SUMMARY OF THE INVENTION

One object of the present invention is to provide a flashing system suitable for use on roof protrusions comprising both head and cheek walls that effectively protects the building envelope from weather-related events.

Another object of the present invention is to provide a flashing system that ensures consistent application of siding to the building envelope in the area surrounding roof protrusions comprising both head and cheek walls.

A flashing system headwall and sloped wall flashing components with ledges provides such benefits, as will be discussed further herein.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

As the ledge of a sloped wall roof flashing terminates at a corner of a dormer or roof protrusion, a complimentary headwall flashing is required to ensure the building envelope is sufficiently protected. More specifically, the angle of the sloped ledge 400 of the sloped wall flashing 400 as it abuts a corner of a cheek wall 304 or similar location needs to be carried around to the front of the wall, i.e. the headwall side, where it can abut headwall flashing also having a ledge 104. If both ledge angles are not the same, relative to the roof slope, they will not interact seamlessly and be able to be joined in a watertight fashion.

Figure 1:
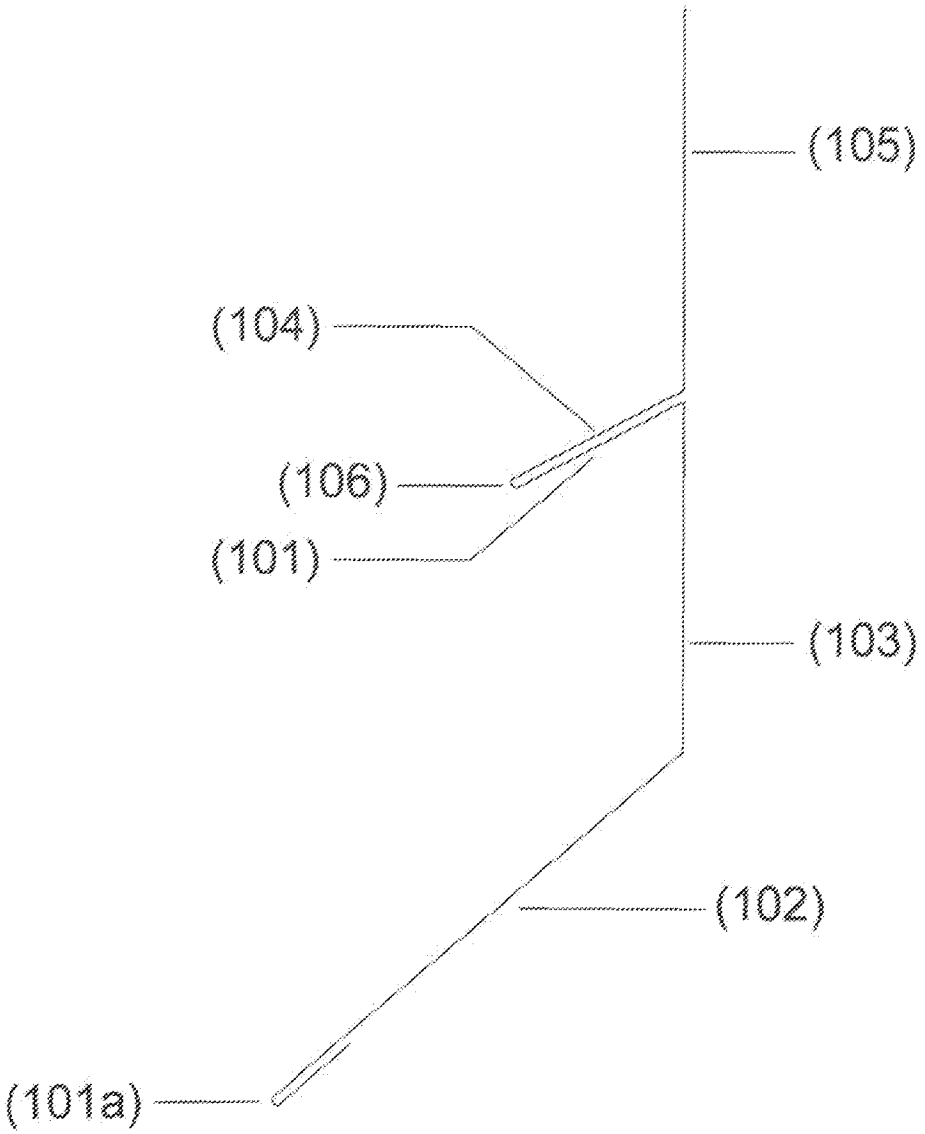
FIG. 1 is a left side elevation view of angled headwall flashing, in accordance with embodiments of the present invention.
Figure 3:
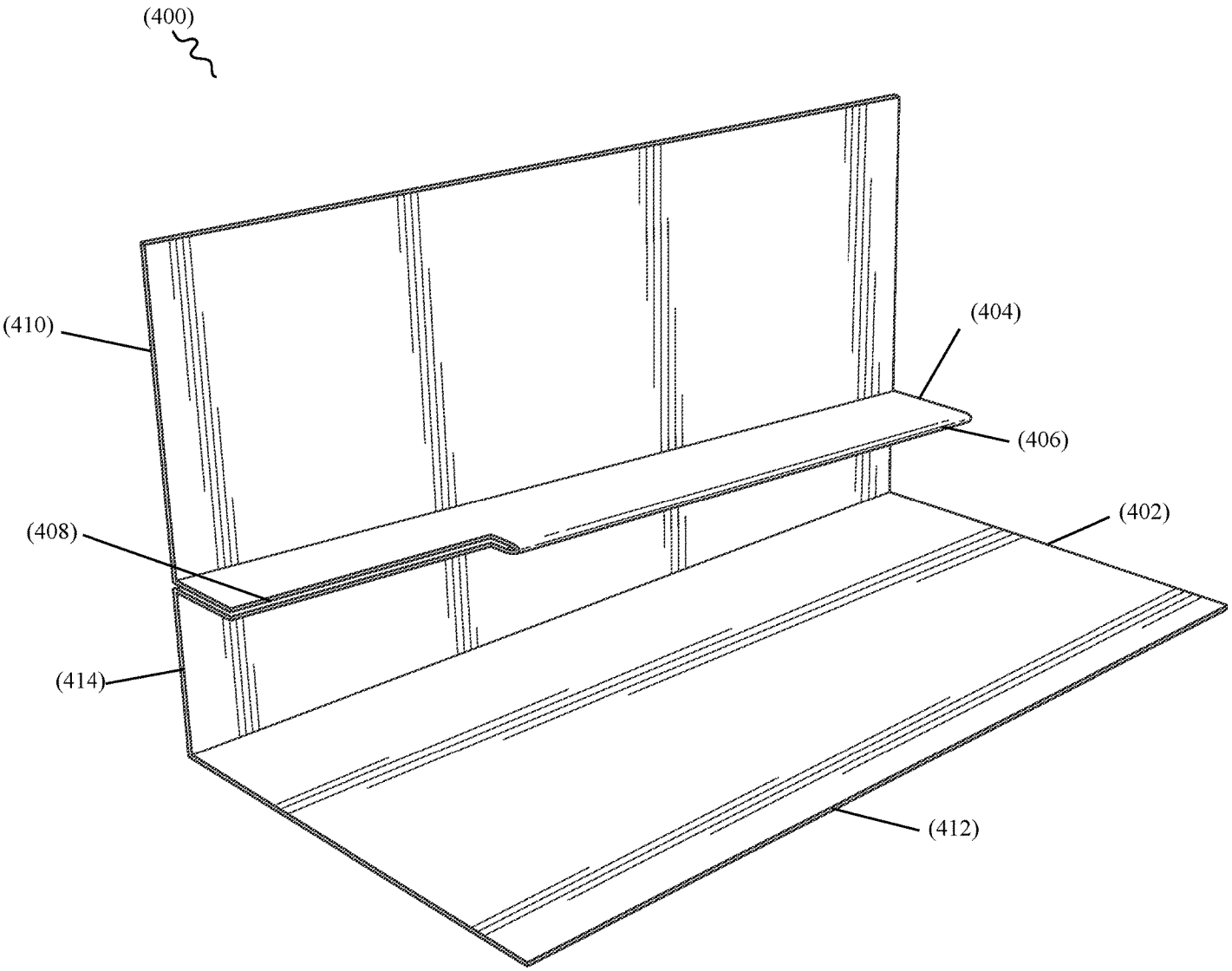
FIG. 3 is a front, upper-left, perspective view of sloped wall flashing (e.g. cheek wall flashing) configured in accordance with embodiments of the present invention.
Figure 4:
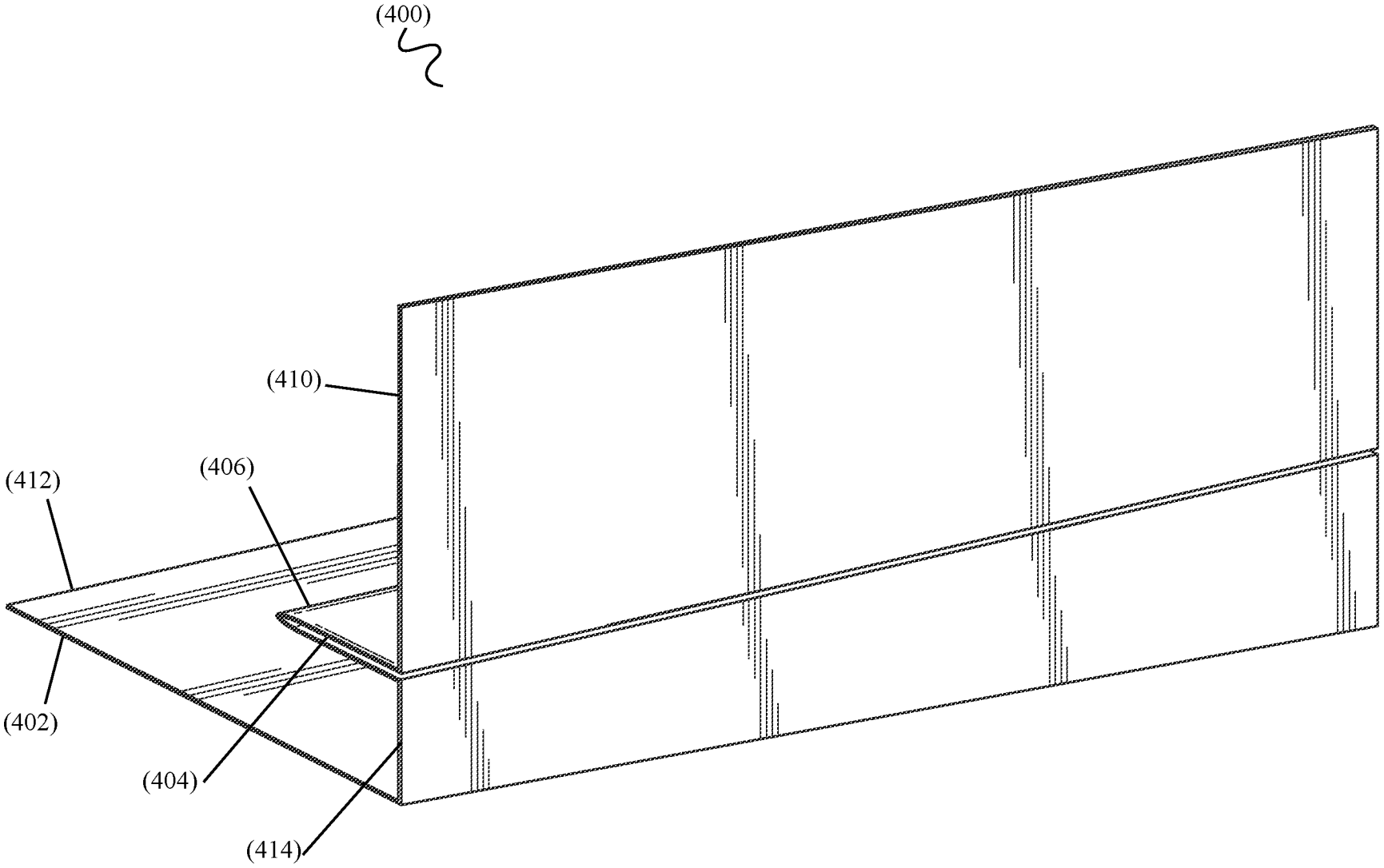
FIG. 4 is a rear, upper-right, perspective view of sloped wall flashing (e.g. cheek wall flashing) configured in accordance with embodiments of the present invention.

Now referring to FIG. 1, headwall flashing with a ledge 104 designed to be used with sloped wall flashing 400, such as that shown in FIGS. 3 and 4, that is fabricated at an angle that corresponds to a roof slope to which it abuts at an outside corner location is shown.

More specifically, the headwall flashing with ledge 104, in embodiments, comprises base flashing 102 that bends upward and becomes lower wall flashing 103 and upper wall flashing 105, which are separated by a ledge 104 positioned on the acute side of the angle formed between the base flashing 102 and lower wall flashing 103, with lower wall flashing 103 and upper wall flashing 105 configured to occupy the substantially same plane.

In embodiments, the base flashing 102 is approximately 3" wide and is angled to match the slope of a roof that abuts a headwall on which the flashing will be used, such that the base flashing 102 sits flat on the roof and the lower wall flashing 103 and upper wall flashing 105 lay flat on the headwall.

In embodiments, the lower wall flashing 103 is approximately 1" tall and may be flexible to allow it to follow the profile of a wall.

In embodiments, the ledge 104 extends approximately 1" out from lower wall flashing 103 and terminates in a nose 106.

In embodiments, the ledge 104 comprises a closed hem 101.

In embodiments, the upper wall flashing 105 extends approximately 3" upwards from said ledge 104.

In embodiments, the base flashing 102 terminates in a closed hem 101*a* opposite the lower wall flashing 103, which helps to prevent oil canning.

In embodiments, the headwall flashing is fabricated in ten foot lengths from 8"-10" wide stock.

Figure 2:
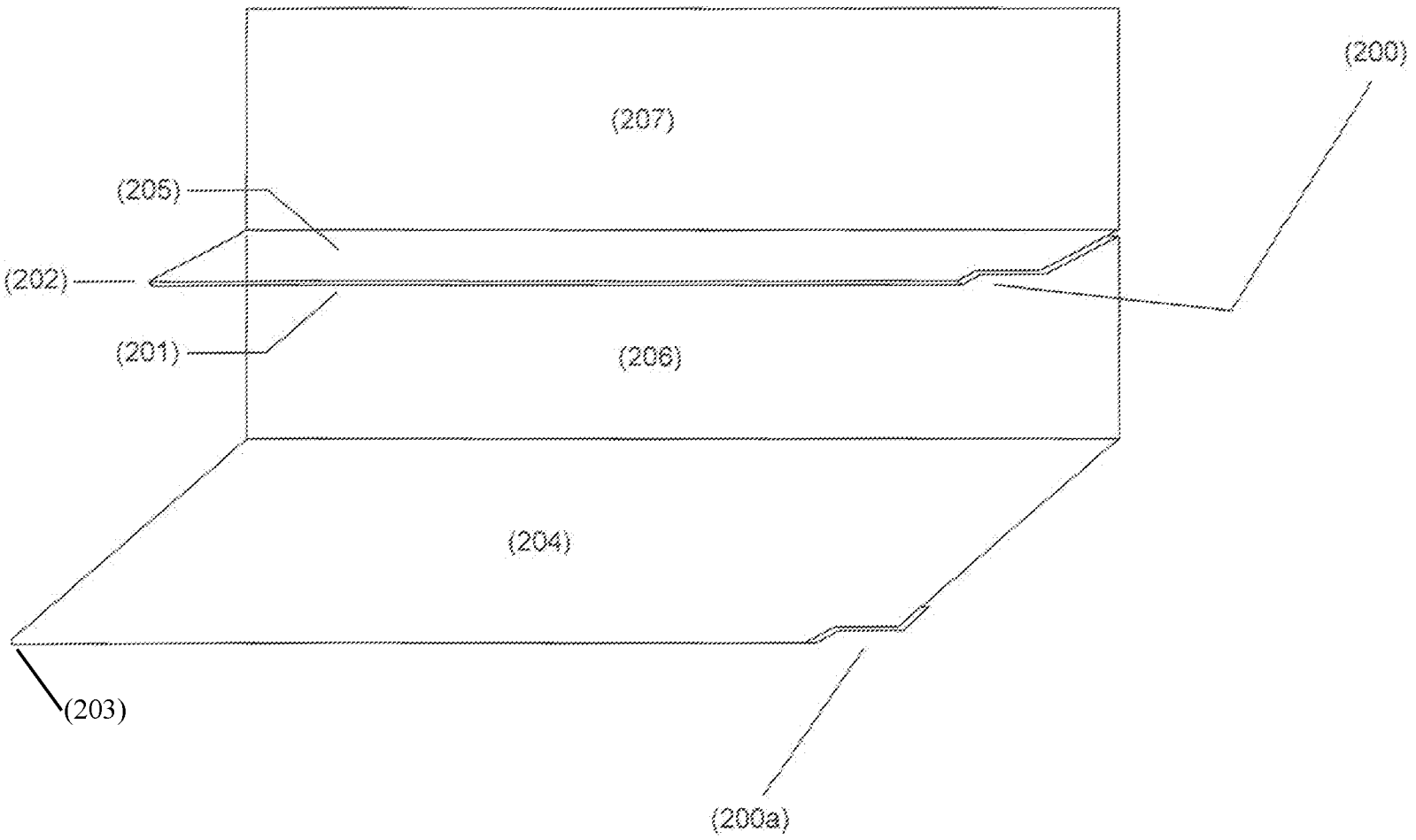
FIG. 2 is a front, upper-right, perspective view of angled headwall flashing, in accordance with embodiments of the present invention.

Now referring to FIG. 2, the headwall flashing of FIG. 1 is shown from a different perspective and with notches (200 and 200*a*) cut therein. These notches (200 and 200*a*) permit one section of headwall flashing to overlap another section of headwall flashing. The notches (200 and 200*a*) can be made on-site using tin snips or cut during manufacturing. The length of the notches (200 and 200*a*) are, in embodiments, approximately equal to the length of a blade on a pair of typical snips, which helps to ensure consistent overlap from section to section without requiring measuring.

In embodiments, both closed hems are notched (201 and 201*a*) to create a clean, straight line along the ledge nose 202 and the base nose 203. This feature allows the sections to be locked together, keeping the base flashing 204 from elevating as it transitions from section to section.

Now referring to FIGS. 3 and 4, sloped wall flashing 400 (e.g. cheek wall 304 flashing) is shown. More specifically, the sloped wall flashing 400, in embodiments, comprises a sloped ledge 404, sloped wall base flashing 402 that bends upward at a substantially perpendicular angle and becomes sloped lower wall flashing 414 and sloped upper wall flashing 410, which are separated by a sloped ledge 404 positioned on the acute side of the angle formed between the sloped wall base flashing 402 and sloped lower wall flashing 414, with sloped lower wall flashing 414 and sloped upper wall flashing 410 configured to occupy substantially the same plane.

Notably, the sloped ledge 404 is positioned more closely to the sloped wall base flashing 402 at one end compared to the other, creating a relatively small angle relative to the sloped wall base flashing 402. In embodiments, the sloped ledge 404 is positioned approximately 1" from the sloped wall base flashing 402 at one end and ¾" at the other. This is done because, on asphalt shingle installations, the sloped wall flashing 400 is integrated into each individual course of shingles abutting the continuous upward slope of a roof protrusion.

In embodiments, the sloped ledge 404 comprises a notch 408 in a higher side thereof, allowing subsequent courses to be cleanly overlapped therewith and tied thereto.

In embodiments, terminal ends of the sloped wall flashing 400 are gaped such that subsequent sections form a continuous cavity therebetween.

In embodiments, terminal ends of the sloped wall flashing 400 are expanded such that subsequent sections of flashing form a continuous cavity therebetween.

Each sloped wall flashing 400 is installed by nailing or otherwise affixing it to a cheek wall 304 or similar through the sloped upper wall flashing 410 portion thereof. After securing the sloped wall flashing 400 to the building envelope, a shingle is laid thereon and secured to the building envelope through the sloped wall base flashing 402, securing both the shingle and the sloped wall flashing 400 thereto. Subsequently, a second piece of sloped wall flashing 400 is overlapped with the first and secured to the building envelope in the same manner. As the overlapped portion is shimmed upwards by the shingle affixed to the previous sloped wall flashing 400, the sloped ledges 404 thereof would not align properly if they were not angled. By angling them such that the narrower portion thereof is downslope of the wider portion thereof, the ledges form a continuous, flat ledge on which siding may be abutted, preventing the wicking of moisture therein that would occur if siding were abutted to the roof itself while providing for a clean and consistent appearance.

Figure 5:
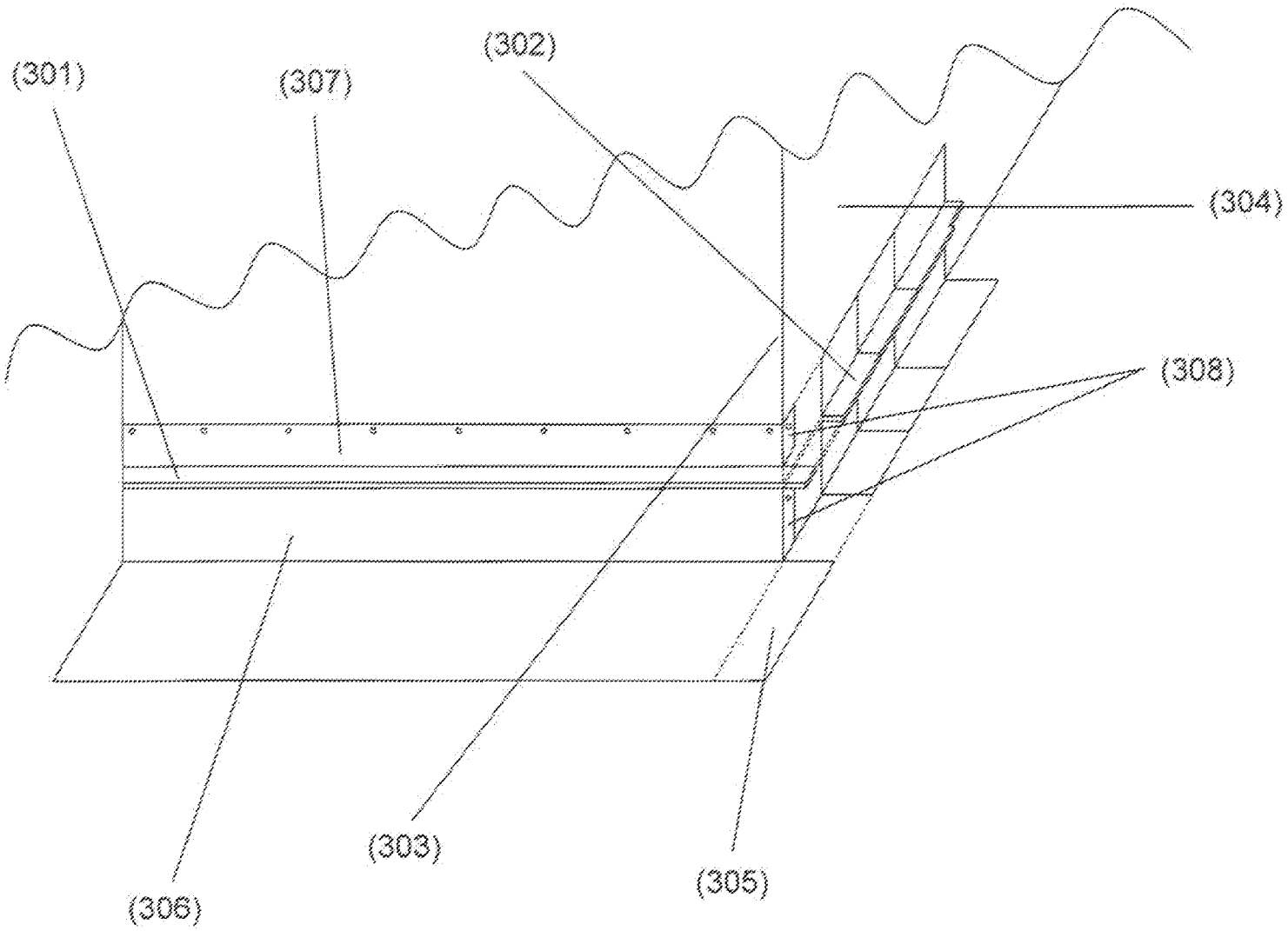
FIG. 5 depicts the flashing shown in FIGS. 1, 2, 3, and 4 fixed to a building envelope, in accordance with embodiments of the present invention.

Furthermore, the sloped ledge 404 is able to cleanly tie into the previously-described headwall flashing with ledge 104 shown in FIGS. 1 and 2, creating a single, continuous ledge that surrounds the roof protrusion and onto which siding can be placed that serves to elevate siding materials off the surface of the roof, preventing wicking of moisture into corner boards and siding components while providing a clean and consistent appearance and easing installation, as will be more fully described, below, with reference to FIG. 5.

In embodiments, the sloped wall flashing 400 comprises a sloped nose 406 created by pressing the sloped ledge into a closed hem.

In embodiments, the sloped wall flashing 400 comprises a closed hem on a front portion thereof 412.

Now referring to FIG. 5, the headwall flashing ledge 301 and step flashing ledge 302 (i.e. the sloped ledge 404) are shown engaging at the corner of a dormer 303. This tight fitment is possible due to the headwall flashing ledge 301 being fabricated at the same roof pitch as the step flashing ledge 302, preventing water intrusion and wicking that would occur if siding were abutted to the roof itself while providing for a clean and consistent appearance by allowing for consistent siding placement surrounding the roof protrusion (e.g. the dormer 303) by allowing the installer to abut the siding to the ledges (301/302) without fear of encouraging moisture to wick into the siding.

Regarding the method of installation of such a flashing system, the headwall flashing is installed first with the headwall flashing ledge 301 extending past a cheek wall 304 (e.g. a dormer cheek wall), to meet with a step flashing ledge 302 (i.e. the sloped ledge 404) that protrudes from the cheek wall 304. In embodiments, the base flashing 305 extends past the dormer 304 wall by approximately 3" and is covered by shingles to the cheek wall 304. The lower wall flashing 306 and the upper wall flashing 307 are then wrapped 308 onto the side of the dormer check wall 304 and fastened using any appropriate fastener.

The step flashing ledge 302 (i.e. the sloped ledge 404) envelopes the headwall flashing ledge 301 at the corner where the two ledges meet, preventing moisture from entering through the interface therebetween. More specifically, as water runs down the step flashing ledge 302 (i.e. the sloped ledge 404) it flows over the headwall flashing ledge 301 and onto the base flashing 305, exiting onto the completed roof surface below.

The base flashing 305, in embodiments, is installed on top of the completed underlying roofing system.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. Headwall flashing comprising:

a base portion configured to rest flatly against a roof surface along substantially an entire bottom surface thereof following installation on a building envelope;

a wall portion extending directly from said base portion wherein said wall portion is configured to abut and be secured to a wall, prior to the installation of siding thereon, following installation on the building envelope;

a closed hem integrated into said wall portion and extending away from said wall portion, forming a ledge; and an upper wall portion extending vertically from said closed hem integrated into said wall portion and configured to abut and be secured to a wall following installation on the building envelope, wherein said closed hem integrated into said wall portion is downwardly-angled relative to said wall portion and said upper wall portion and substantially parallel with said base portion, forming an acute angle with said wall portion and an obtuse angle with said upper wall portion, and wherein the angle between said base portion and said wall portion is obtuse.

2. The headwall flashing of claim 1 further comprising a notch in at least one outside corner of said closed hem integrated into said wall portion.

3. The headwall flashing of claim 2 further comprising a notch in at least one outside corner of said base portion.

4. The headwall flashing of claim 3 wherein said notches are located on the same side of the headwall flashing.

5. The headwall flashing of claim 1 wherein said headwall flashing is of a unitary construction.

6. The headwall flashing of claim 1 wherein said wall portion is 1" tall.

7. The headwall flashing of claim 1 wherein said base portion is 3" wide.

8. The headwall flashing of claim 1 wherein said closed hem integrated into said wall portion and extending away from said wall portion extends 1" away from said wall portion.

9. Sloped wall flashing comprising:

a base portion configured to rest flatly against a roof surface along substantially an entire bottom surface thereof following installation on a building envelope adjacent a cheek wall;

a wall portion extending directly from said base portion wherein said wall portion is configured to abut and be secured to a cheek wall, prior to the installation of siding thereon, following installation on the building envelope adjacent the cheek wall;

a closed hem integrated into said wall portion and extending substantially perpendicularly away from said wall portion, forming a ledge; and an upper wall portion extending vertically from said closed hem integrated into said wall portion and configured to abut and be secured to the cheek wall following installation on the building envelope adjacent the cheek wall, wherein said closed hem integrated into said wall portion is downwardly-angled relative to said base portion, in a direction parallel to said wall, resulting in one side thereof being vertically closer to said base portion than the other, and wherein, over the length of the closed hem integrated into said wall portion, the downward angle thereof brings said closed hem integrated into said wall portion one shingle thickness closer to said base portion.

10. The sloped wall flashing of claim 9 wherein said base portion and said wall portion are perpendicular.

11. The sloped wall flashing of claim 9 further comprising a notch in at least one outside corner of said closed hem integrated into said wall portion.

12. The sloped wall flashing of claim 11 wherein said notch is located in the higher end of said closed hem integrated into said wall portion.

13. The sloped wall flashing of claim 9 wherein a distal end of the sloped wall flashing is gaped such that the distal end of the sloped wall flashing interlocks with a proximal end of a second sloped wall flashing.

14. The sloped wall flashing of claim 9 wherein a distal end of the sloped wall flashing is expanded such that the distal end of the sloped wall flashing interlocks with a proximal end of a second sloped wall flashing.

15. A kit comprising the headwall flashing of claim 1 and sloped wall flashing comprising:

a sloped wall flashing base portion configured to rest flatly against a roof surface along substantially an entire bottom surface thereof following installation on a building envelope adjacent a cheek wall;

a sloped wall flashing wall portion extending directly from said sloped wall flashing base portion wherein said sloped wall flashing wall portion is configured to abut and be secured to a cheek wall, prior to the installation of siding thereon, following installation on the building envelope adjacent the cheek wall;

a sloped wall flashing closed hem integrated into said sloped wall flashing wall portion and extending substantially perpendicularly away from said sloped wall flashing wall portion, forming a sloped wall flashing ledge; and a sloped wall flashing upper wall portion extending vertically from said sloped wall flashing closed hem integrated into said sloped wall flashing wall portion and configured to abut and be secured to the cheek wall following installation on the building envelope adjacent the cheek wall, wherein said sloped wall flashing closed hem integrated into said sloped wall flashing wall portion is downwardly-angled relative to said sloped wall flashing base portion, in a direction parallel to said wall, resulting in one side thereof being vertically closer to said sloped wall flashing base portion than the other, and wherein, over the length of the sloped wall flashing closed hem integrated into said sloped wall flashing wall portion, the downward angle thereof brings said sloped wall flashing closed hem integrated into said sloped wall flashing wall portion one shingle thickness closer to said sloped wall flashing base portion.

16. The sloped wall flashing of claim 9 wherein, over the length of the closed hem integrated into said wall portion, the downward angle thereof brings said closed hem integrated into said wall portion between ⅛" to ¾" closer to said base portion.

17. The kit of claim 15 wherein a terminal portion of the closed hem of the headwall flashing and a terminal portion of the sloped wall flashing closed hem are configured, once installed on a roof with a roofing shingle inserted underneath at least a portion of the sloped wall flashing base portion, to meet at the same height, and wherein the sloped wall flashing ledge is configured to be parallel to the roof along its length.

18. The sloped wall flashing of claim 9 wherein said sloped wall flashing is between 5" and 12" long.

19. A method of waterproofing a building envelope in the region of a roofing protrusion using the headwall flashing of claim 1, the method comprising:

cutting a slit along the closed hem integrated into said wall portion at an interface between the closed hem and the wall portion and again at an interface between the closed hem and upper wall portion;

cutting a slit along an interface between the base portion and the wall portion;

installing the headwall flashing against a headwall of the roofing protrusion with the ledge thereof extending past the headwall;

wrapping the wall portion and upper wall portion around an interface between said cheek wall and said headwall;

installing a first piece of sloped wall flashing to a cheek wall of the roofing protrusion with the ledge thereof extending past the cheek wall at the interface between said cheek wall and said headwall;

installing a shingle onto said sloped wall flashing;

installing a second piece of sloped wall flashing to the cheek wall, overlapping said second piece of sloped wall flashing with the first piece of sloped wall flashing; and continuing to apply said sloped wall flashing and shingles to the cheek wall until the cheek wall is fully flashed, wherein said sloped wall flashing comprises:

a sloped wall flashing base portion configured to rest flatly against a roof surface along substantially an entire bottom surface thereof following installation on a building envelope adjacent a cheek wall;

a sloped wall flashing wall portion extending directly from said sloped wall flashing base portion wherein said sloped wall flashing wall portion is configured to abut and be secured to a cheek wall, prior to the installation of siding thereon, following installation on the building envelope adjacent the cheek wall;

a sloped wall flashing closed hem integrated into said sloped wall flashing wall portion and extending substantially perpendicularly away from said sloped wall flashing wall portion, forming a sloped wall flashing ledge; and a sloped wall flashing upper wall portion extending vertically from said sloped wall flashing closed hem integrated into said sloped wall flashing wall portion and configured to abut and be secured to the cheek wall following installation on the building envelope adjacent the cheek wall, wherein said sloped wall flashing closed hem integrated into said sloped wall flashing wall portion is downwardly-angled relative to said sloped wall flashing base portion, in a direction parallel to said wall, resulting in one side thereof being vertically closer to said sloped wall flashing base portion than the other, and wherein, over the length of the sloped wall flashing closed hem integrated into said sloped wall flashing wall portion, the downward angle thereof brings said sloped wall flashing closed hem integrated into said sloped wall flashing wall portion one shingle thickness closer to said sloped wall flashing base portion.

20. The method of claim 19 wherein the ledge of said headwall flashing is installed such that it extends past the headwall by 1".

21. The method of claim 19 wherein said headwall flashing is installed on top of a completed roofing system.

22. The method of claim 19 wherein said sloped wall flashing further comprises sloped wall flashing notches into which subsequent sections can be inserted to ensure correct alignment and prevent water intrusion.

* * * * *